US007530212B2

(12) United States Patent
Lee

(10) Patent No.: US 7,530,212 B2
(45) Date of Patent: May 12, 2009

(54) PORTABLE VACUUM PACKAGING MACHINE

(75) Inventor: Kyul-Joo Lee, Kyonggido (KR)

(73) Assignee: Sunbeam Products, Inc., Boca Raton, FL (US)

( * ) Notice: Subject to any disclaimer, the term of this patent is extended or adjusted under 35 U.S.C. 154(b) by 851 days.

(21) Appl. No.: 10/468,608

(22) PCT Filed: May 9, 2001

(86) PCT No.: PCT/KR01/00747

§ 371 (c)(1),
(2), (4) Date: Feb. 2, 2004

(87) PCT Pub. No.: WO02/068270

PCT Pub. Date: Sep. 6, 2002

(65) Prior Publication Data

US 2004/0134168 A1 Jul. 15, 2004

(30) Foreign Application Priority Data

Feb. 28, 2001 (KR) ..... 2001-10585

(51) Int. Cl.
*B65B 31/00* (2006.01)

(52) U.S. Cl. ..... 53/510; 53/390; 53/507; 53/512

(58) Field of Classification Search ..... 53/374.8, 53/374.9, 375.6, 390, 432–434, 507, 510, 53/511, 512

See application file for complete search history.

(56) References Cited

U.S. PATENT DOCUMENTS

| | | | | | |
|---|---|---|---|---|---|
| 2,991,609 | A * | 7/1961 | Randall | 53/374.9 |
| 3,377,769 | A * | 4/1968 | Bridgeman | 53/84 |
| 3,808,876 | A * | 5/1974 | Kershaw | 73/38 |
| 4,066,931 | A * | 1/1978 | Morrill | 315/241 R |
| 4,105,491 | A | 8/1978 | Haase et al. | |
| 4,631,006 | A * | 12/1986 | Murray | 417/234 |
| 4,931,310 | A * | 6/1990 | Anschel et al. | 427/520 |
| 4,941,310 | A | 7/1990 | Kristen | |
| 5,048,269 | A * | 9/1991 | Deni | 53/512 |
| 5,121,590 | A * | 6/1992 | Scanlan | 53/510 |
| 5,215,445 | A * | 6/1993 | Chen | 417/313 |
| 5,352,323 | A * | 10/1994 | Chi | 156/583.9 |
| 5,638,664 | A * | 6/1997 | Levsen et al. | 53/512 |
| 5,765,608 | A | 6/1998 | Kristen | |
| 5,893,822 | A * | 4/1999 | Deni et al. | 53/512 |
| 6,520,071 | B1 | 2/2003 | Lanza | |
| 6,543,491 | B1 * | 4/2003 | Chung | 141/65 |

FOREIGN PATENT DOCUMENTS

| | | |
|---|---|---|
| EP | 0723915 A1 | 7/1996 |
| EP | 1053945 A1 | 11/2000 |
| WO | WO00/71422 | 11/2000 |

* cited by examiner

*Primary Examiner*—Thanh K Truong
(74) *Attorney, Agent, or Firm*—Lawrence J. Shurupoff

(57) ABSTRACT

The present invention relates to a portable vacuum packaging machine which, other than a conventional vacuum packaging machine composed of a bulky and weighty single component element, is configured in such a way as to be divided into a body section and a head section, whereby a vacuum packaging work can be conveniently implemented using the head section without requiring movement of the body section, irrespective of place so long as a flat condition is satisfied.

1 Claim, 7 Drawing Sheets

PORTABLE VACUUM PACKAGING MACHINE

TECHNICAL FIELD

The present invention relates to a vacuum packaging machine, and more particularly, the present invention relates to a portable vacuum packaging machine which, other than a conventional vacuum packaging machine composed of a bulky and weighty single component element, is configured in such a way as to be divided into a body section and a head section, whereby a vacuum packaging work can be conveniently implemented using the head section without requiring movement of the body section, irrespective of place so long as a flat condition is satisfied.

BACKGROUND ART

Generally, a vacuum packaging machine of a type which has a vacuum chamber for treating items to be packaged, includes a body. The body has a rectangular box-shaped configuration which is opened at an upper end thereof. The vacuum chamber is defined in the body. A cover is located on the upper end of the body so that it can open and close the vacuum chamber. A vacuum pump for creating a vacuum pressure, arrangements associated with the vacuum pump, and a sealing device for sealing, by virtue of heat-fusion, an entrance of a vinyl package in which vacuum is already introduced, are disposed in the body which has the cover connected thereto. Further, the vacuum packaging machine has mounted thereto parts such as a pressure gauge which allows a user to confirm, with the naked eye, a current vacuum pressure governing the vacuum chamber, an on/off switch for controlling operation of the vacuum pump, an indicator lamp for indicating an operational status of the vacuum pump, and the like.

However, the conventional vacuum packaging machine constructed as mentioned above suffers from defects in that, since it is composed of a bulky and weighty single component element, its movability cannot but be deteriorated. Also, as a result of this, because a vacuum packaging work is implemented at a fixed position, not only bothersomeness and inconvenience are induced, but also inefficiency and productivity degradation are caused. Moreover, due to expensiveness of the conventional vacuum packaging machine, a heavy burden is imposed on the user in terms of cost.

DISCLOSURE OF THE INVENTION

Accordingly, the present invention has been made in an effort to solve the problems occurring in the related art, and an object of the present invention is to provide a portable vacuum packaging machine which is configured in such a way as to be divided into a body section and a head section, whereby a vacuum packaging work can be implemented using the head section without requiring movement of the body section, irrespective of place so long as a flat condition is satisfied.

In order to achieve the above object, according to one aspect of the present invention, there is provided a portable vacuum packaging machine comprising: a body section having disposed therein a vacuum pump and formed on an upper surface thereof with a carrying handle; and a head section electrically connected with the body section and having an upper cover part wherein a moving handle is formed on an upper surface of the upper cover part, a pair of operation switches and a pair of indicator lamps are respectively located at both sides of the moving handle, and a pressure gauge is located at a side of the moving handle, and a lower substructure part wherein a vacuum chamber is defined on a lower surface of the lower substructure part, a packing is located on the lower surface and adjacent to edges of the lower substructure part, a gauge installing hole and an air suction hole which communicates the body section and the vacuum chamber with each other via a connection tube, are defined in the lower substructure part, and a heat-fusing portion is formed at a side of the vacuum chamber and on the lower surface of the lower substructure part.

According to another aspect of the present invention, a timer for setting a vacuum pressure applying time and a pressure-adjusting portion for adjusting a vacuum pressure are located on a side surface of the upper cover part of the head section.

According to still another aspect of the present invention, a pair of heat-fusing portions are formed at front and rear sides of the vacuum chamber and on the lower surface of the lower substructure part.

BRIEF DESCRIPTION OF THE DRAWINGS

The above objects, and other features and advantages of the present invention will become more apparent after a reading of the following detailed description when taken in conjunction with the drawings, in which:

FIGS. 2*a* through 2*d* illustrate a head section which constitutes the portable vacuum packaging machine according to the present invention, wherein FIG. 2*a* is a perspective view, FIG. 2*b* is an exploded bottom perspective view, FIG. 2*c* is a plan view and FIG. 2*d* is a side view.

BEST MODE FOR CARRYING OUT THE INVENTION

Figure 1:
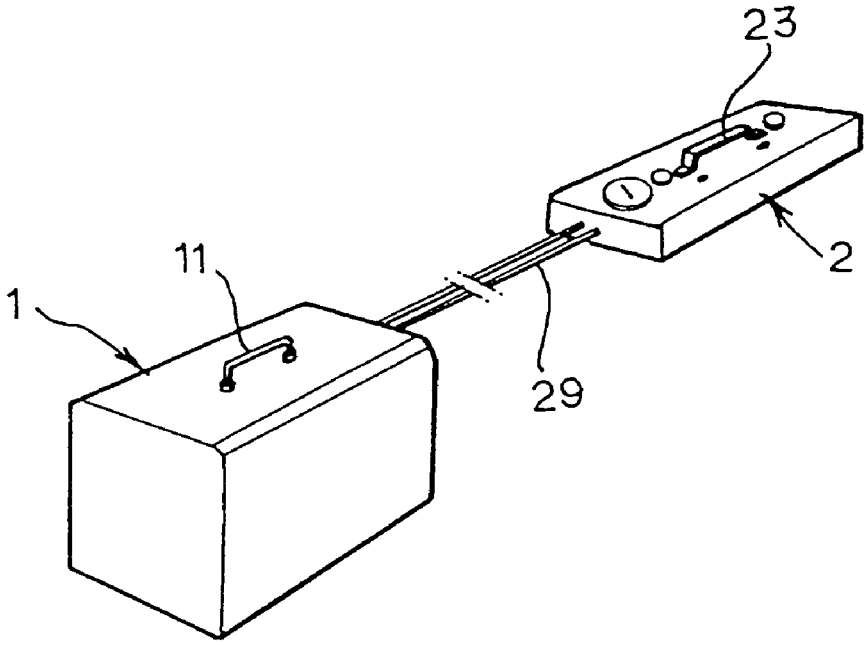
FIG. 1 is a perspective view illustrating an entire construction of a portable vacuum packaging machine in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a perspective view illustrating an entire construction of a portable vacuum packaging machine in accordance with an embodiment of the present invention.

As shown in FIG. 1, the portable vacuum packaging machine according to the present invention is configured in a manner such that it is divided into a body section 1 and a head section 2. The body section 1 has disposed therein a vacuum pump (not shown) which is operated by power supply from an external power source to create a vacuum pressure. The head section 2 functions to completely take air out of a vinyl package (not shown) using suction force generated by operation of the vacuum pump thereby to maintain the vinyl package under a vacuum state, and to seal an entrance of the vinyl package by virtue of heat-fusion. The body section 1 and the head section 2 are electrically connected with each other via a flexible connection tube 29 so that the head section 2 can be freely moved relative to the body section 1. A carrying handle 11 is formed on an upper surface of the body section 1 so as to allow the, body section 1 to be easily carried around. Also, a moving handle 23 is formed on an upper surface of the head section 2 so as to allow the head section 2 to be easily moved. Here, a vinyl packaging envelope in which an air path is defined, is used as the vinyl package.

FIGS. 2*a* through 2*d* illustrate the head section which constitutes the portable vacuum packaging machine according to the present invention.

Figure 2A:
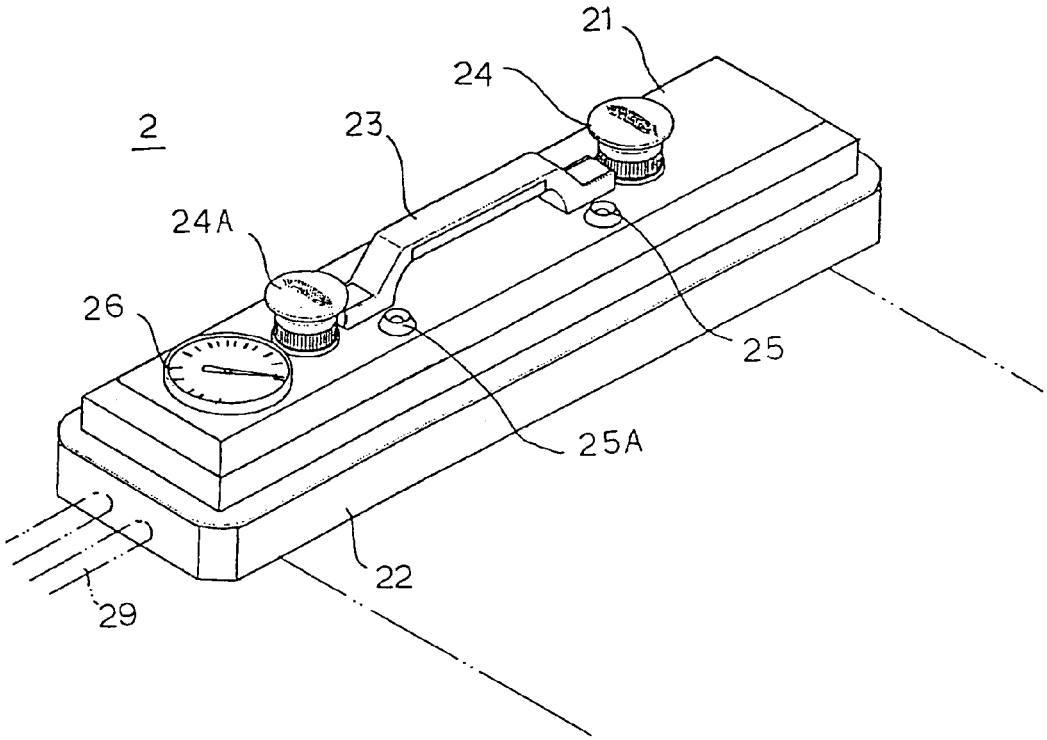

Referring to FIG. 2*a* which is a perspective view of the head section, the head section 2 has an elongate rectangular configuration, and is constituted by an upper cover part 21 and a lower substructure part 22. The moving handle 23 is formed on an upper surface of the upper cover part 21. A pair of operation switches 24 and 24A which can be pushed to turn on and off operation of the vacuum pump of the body section 1, are respectively located at both sides of the moving handle 23. A pair of indicator lamps 25 and 25A are also respectively located at both sides of the moving handle 23 in front of the pair of operation switches 24 and 24A so that a user can confirm, with the naked eye, an operational status of the vacuum pump through flickering of the pair of indicator lamps 25 or 25A. Also, a pressure gauge 26 for showing a current vacuum pressure which governs a vacuum chamber 30 as will be stated later in detail, is located at a side on the upper surface of the upper cover part 21.

Figure 2B:
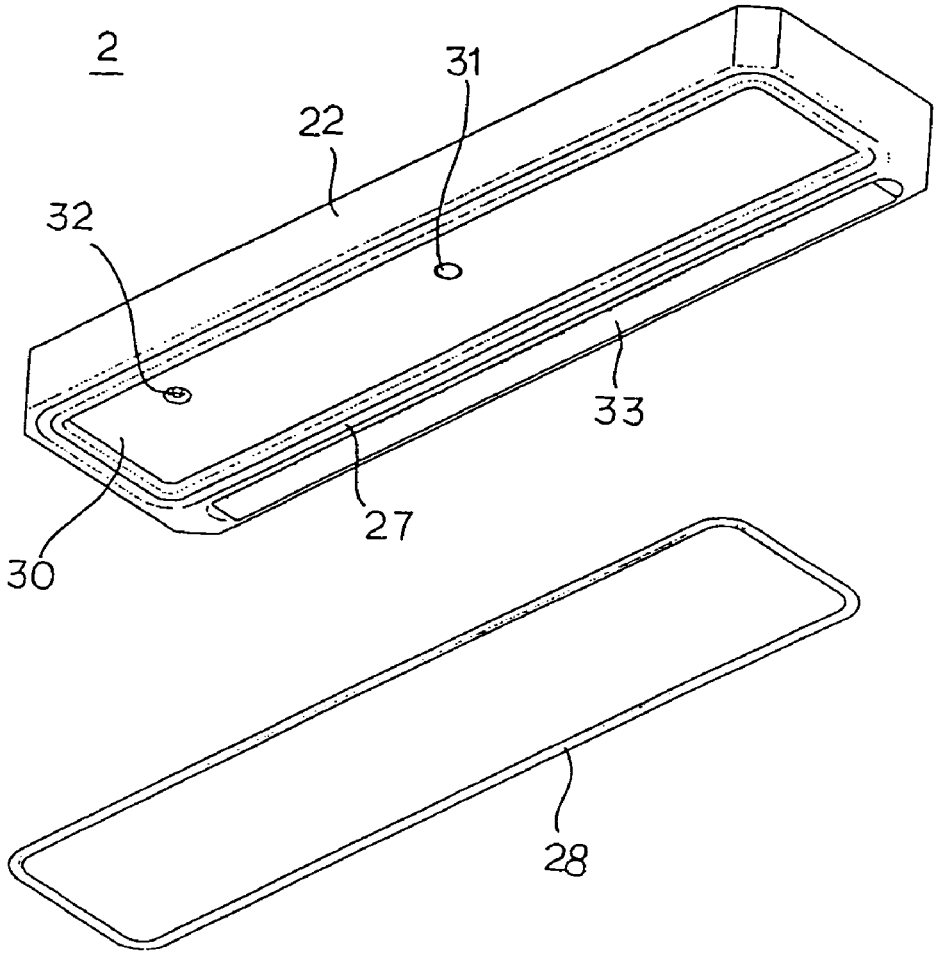

Referring to FIG. 2*b* which is an exploded bottom perspective view of the head section, the lower substructure part 22 of the head section 2 has a block-shaped configuration. The vacuum chamber 30 is defined in the form of a groove on a center portion of a lower surface of the lower substructure part 22. A packing groove 27 is defined on the lower surface of the lower substructure part 22 around the vacuum chamber 30. A packing 28 which is made of rubber, is fitted into the packing groove 27 so as to guarantee airtight closing of the vacuum chamber 30 upon implementing a vacuum packaging work. An air suction hole 31 is defined on a bottom surface delimiting the vacuum chamber 30 in a manner such that suction force due to a vacuum pressure created in the body section 1, can be introduced into the vacuum chamber 30 through the air suction hole 31. A gauge installing hole 32 is also defined on the bottom surface delimiting the vacuum chamber 30 at a side of the air suction hole 31. Further, a heat-fusing portion 33 is formed adjacent a front end (shown as a rear end in the drawing) of the vacuum chamber 30 on the lower surface of the lower substructure part 22, so as to seal an entrance of the vinyl package upon power supply.

Figure 2C:
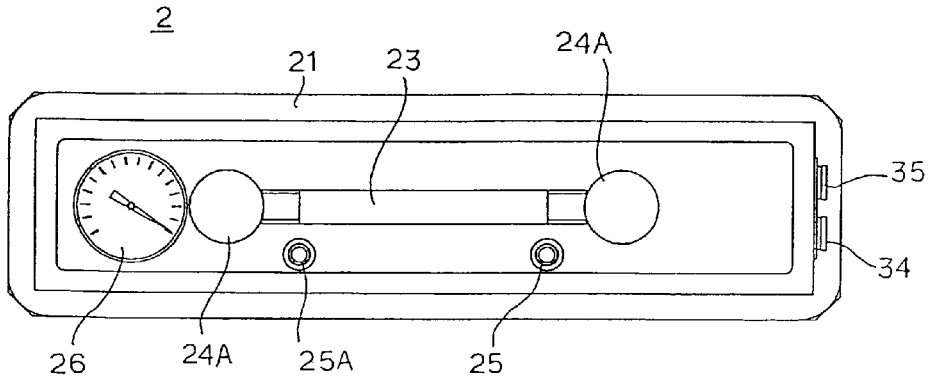
Figure 2D:
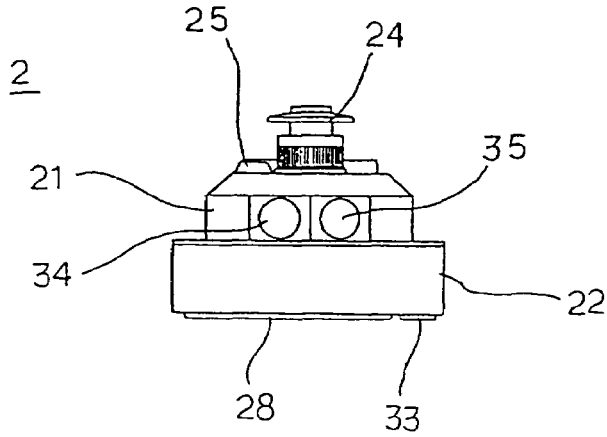

Referring to FIGS. 2*c* and 2*d* which are respectively a plan view and a side view of the head section, the moving handle 23 is formed on the upper surface of the upper cover part 21 of the head section 2. The pair of operation switches 24 and 24A which can be pushed to turn on and off operation of the vacuum pump of the body section 1, are respectively located at both sides of the moving handle 23. The pair of indicator lamps 25 and 25A are also respectively located at both sides of the moving handle 23 in front of the pair of operation switches 24 and 24A. Further, the pressure gauge 26 for showing a current vacuum pressure which governs the vacuum chamber 30, is located at the side of the moving handle 23. A timer 34 for setting an operation time of the vacuum pump of the body section 1 to a desired one and a pressure-adjusting portion 35 for adjusting suction force due to the vacuum pressure of the vacuum pump are located on a side surface of the upper cover part 21 of the head section 2. As described above, the drawing reference numeral 28 designates the packing and 33, the heat-fusing portion.

Figure 2E:
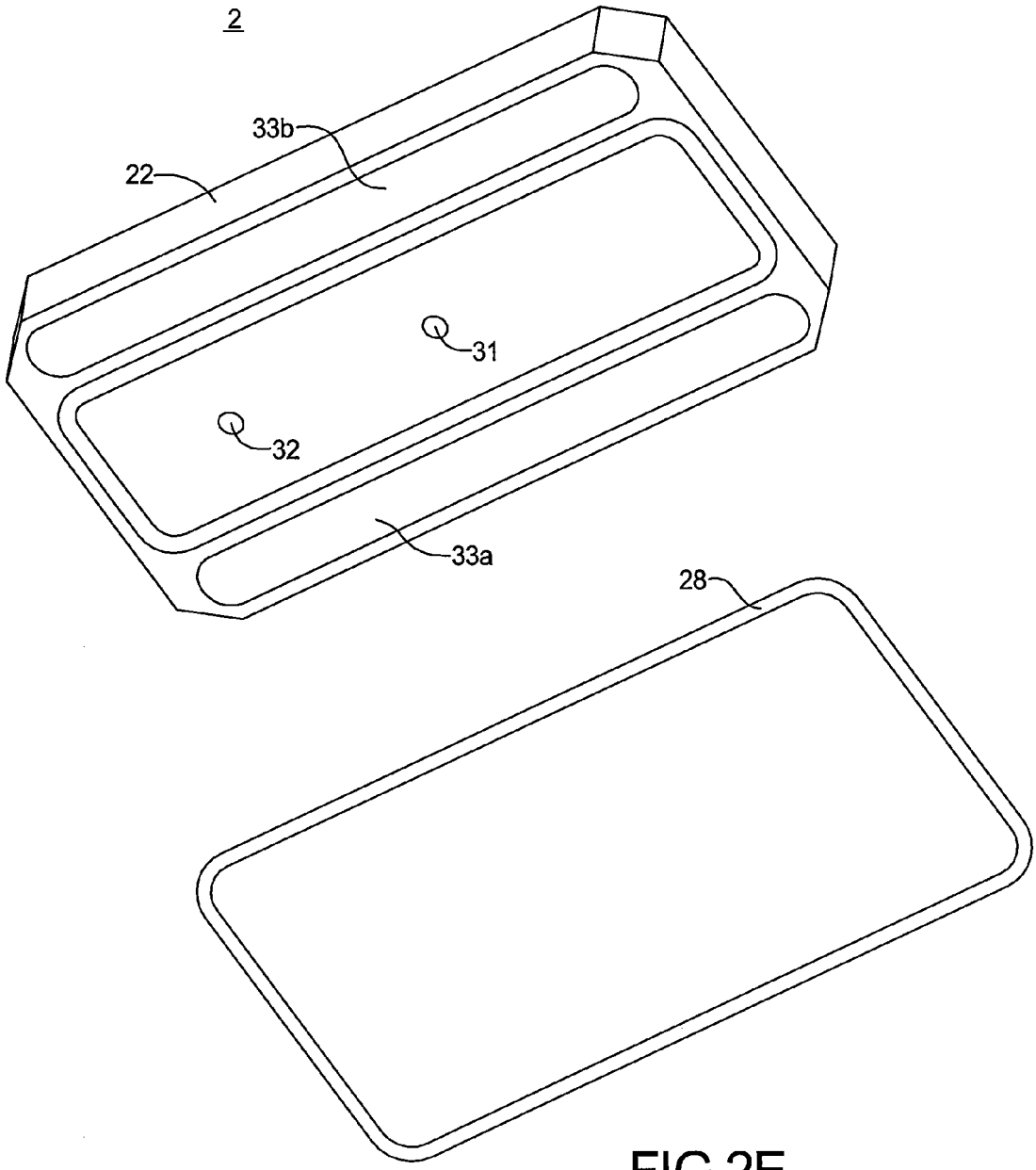
FIG. 2*e* illustrates an exploded bottom view perspective view of an alternate embodiment of a head section of a portable vacuum packaging machine.

Referring to FIG. 2*e* which is an exploded bottom perspective view of an alternate embodiment of the head section, the lower substructure part 22 of the head section 2 has a block-shaped configuration. The vacuum chamber 30 is defined in the form of a groove on a center portion of a lower surface of the lower substructure part 22. A packing groove 27 is defined on the lower surface of the lower substructure part 22 around the vacuum chamber 30. A packing 28 which is made of rubber, is fitted into the packing groove 27 so as to guarantee airtight closing of the vacuum chamber 30 upon implementing a vacuum packaging work. The packing 28 in the packing groove 27 may act as a sealing gasket. An air suction hole 31 is defined on a bottom surface delimiting the vacuum chamber 30 in a manner such that suction force due to a vacuum pressure created in the body section 1, can be introduced into the vacuum chamber 30 through the air suction hole 31. A gauge installing hole 32 is also defined on the bottom surface delimiting the vacuum chamber 30 at a side of the air suction hole 31. Further, two heat-fusing portions 33*a* and 33*b* are formed adjacent a front end and read end of the vacuum chamber 30 on the lower surface of the lower substructure part 22, so as to seal the vinyl package upon power supply.

Figure 3:
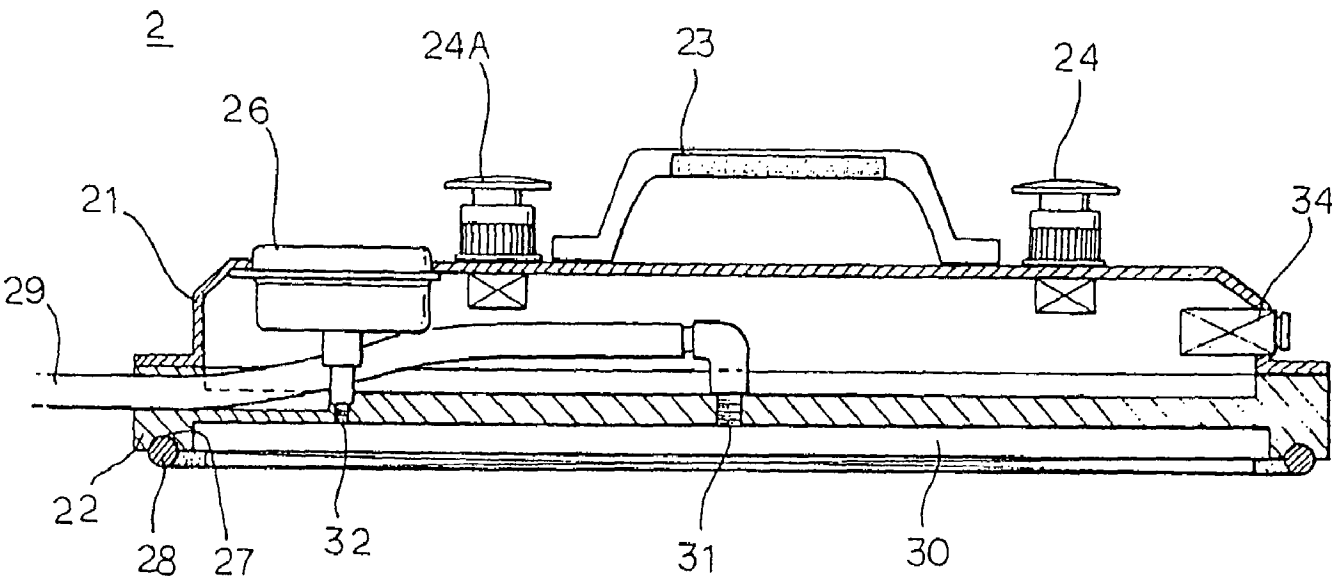
FIG. 3 is a cross-sectional view illustrating an internal structure of the head section.

FIG. 3 is a cross-sectional view illustrating an internal structure of the head section.

As shown in FIG. 3, the head section 2 is constituted by the upper cover part 21 and the lower substructure part 22. The upper cover part 21 and the lower substructure part 22 are assembled and coupled with each other by means of locking means such as screws. The pair of operation switches 24 and 24A are respectively located at both sides of the moving handle 23. The pressure gauge 26 for showing a current vacuum pressure which governs the vacuum chamber 30, is located at the side of the moving handle 23. And, the timer 34 and the pressure-adjusting portion 35 are located on the side surface of the upper cover part 21 of the head section 2.

In addition, the vacuum chamber 30 is defined in the form of the groove on the center portion of the lower surface of the lower substructure part 22. The packing 28 is fitted into the packing groove 27 around the vacuum chamber 30. The heat-fusing portion 33 is formed adjacent the front end of the vacuum chamber 30 on the lower surface of the lower substructure part 22. The air suction hole 31 is defined on the bottom surface delimiting the vacuum chamber 30 in a manner such that the air suction hole 31 communicates the body section 1 and the vacuum chamber 30 with each other via the flexible connection tube 29, and the gauge installing hole 32 is also defined on the bottom surface delimiting the vacuum chamber 30 at the side of the air suction hole 31.

Hereinafter, an operational procedure and working effects of the portable vacuum packaging machine according to the present invention, constructed as mentioned above, will be described in detail.

First, a person skill in the art will readily appreciate that the vacuum packaging work is implemented on a flat surface. That is to say, after foodstuff to be stored for a lengthy period of time is accommodated in the vinyl package on the flat surface, the head section 2 is laid on the vinyl pack so that the entrance of the vinyl package is positioned in the vacuum chamber 30 of the head section 2.

In this state, as the first operation switch 24 of the head section 2 is pushed, the vacuum pump of the body section 1 is operated by an operating instruction signal, and thereby an internal vacuum pressure is created. By this, suction force is introduced in the air suction hole 31 which is connected with the body section 1 via the flexible connection tube 29. According to this, as air existing in the vinyl package is completely discharged out of the vinyl package through the entrance, the inside of the vinyl package is maintained under a vacuum state. Thereupon, as power is supplied to the heat fusing portion 33, the entrance of the vinyl package is sealed by heat-fusion, whereby the vacuum packaging procedure is finished.

In the meanwhile, a person skilled in the art will readily recognize that the heat-fusing portion 33 can be formed adjacent to front and rear ends, or four ends including front, rear, left and right ends, of the vacuum chamber 30 of the head section 2. Furthermore, a number of head sections 2 can be connected to the single body section 1, in a manner such that a plurality of users can simultaneously implement vacuum packaging works.

INDUSTRIAL APPLICABILITY

As a result, the portable vacuum packaging machine according to the present invention provides advantages in that, since the portable vacuum packaging machine is configured in such a way as to be divided into a body section for creating a vacuum pressure and a head section by which a packaging work is implemented using the vacuum pressure, and arrangements associated with the vacuum packaging work, such as an operation on/off switch, are attached to the head section, a vacuum packaging work can be conveniently implemented using the head section without requiring movement of the body section, irrespective of place so long as a flat condition is satisfied.

Also, due to this, not only it is possible to ensure convenience and efficiency upon implementing the vacuum packaging work, but also productivity can be improved.

Furthermore, owing to structural simplicity of the vacuum packaging machine, a manufacturing cost can be reduced, and thereby, a heavy burden is not imposed on a user in terms of cost.

The invention claimed is:

1. A portable vacuum packaging machine comprising:

a body section having disposed therein a vacuum pump and formed on an upper cover part thereof with a handle;

a head section electrically connected with the body section and having an upper cover part wherein a handle is formed on an upper surface of the upper cover part, a pair of operation switches and a pair of indicator lamps are respectively located at both sides of the handle, and a pressure gauge is located at a side of the handle, and a lower substructure part wherein a vacuum chamber is defined on a lower surface of the lower substructure part, a packing is located on the lower surface and adjacent to edges of the lower substructure part, a gauge installing hole and an air suction hole which communicates the body section and the vacuum chamber with each other via a connection tube, are defined in the lower substructure part, and a heat-fusing portion is formed at a side of the vacuum chamber and on the lower surface of the lower substructure part; and wherein a timer for setting a vacuum pressure applying time and a pressure-adjusting portion for adjusting a vacuum pressure are located on a side surface of the upper cover part of the head section.

* * * * *